United States Patent [19]

Cusack

[11] Patent Number: 4,795,318

[45] **Date of Patent: * Jan. 3, 1989**

[54] MAGNETOSTRICTIVE PUMP

[75] Inventor: Robert F. Cusack, Grosse Pointe Park, Mich.

[73] Assignee: GTE Valeron Corporation, Troy, Mich.

[ * ] Notice: The portion of the term of this patent subsequent to Feb. 23, 2005 has been disclaimed.

[21] Appl. No.: 905,006

[22] Filed: Sep. 8, 1986

Related U.S. Application Data

[63] Continuation-in-part of Ser. No. 759,557, Jul. 26, 1985, abandoned, and a continuation-in-part of Ser. No. 759,558, Jul. 26, 1985, abandoned, and a continuation-in-part of Ser. No. 759,552, Jul. 26, 1985, abandoned.

[51] Int. Cl.[4] ..... F04B 17/00; F04B 35/00

[52] U.S. Cl. ..... 417/322; 417/410; 310/26

[58] Field of Search ..... 417/322, 410, 417, 505; 310/26

[56] References Cited

U.S. PATENT DOCUMENTS

| | | | |
|---|---|---|---|
| 1,092,453 | 4/1914 | Rainey | 310/26 |
| 2,772,862 | 12/1956 | Van Suchtelen | 310/26 |
| 2,776,417 | 1/1957 | Harris | 310/26 |
| 2,842,067 | 7/1958 | Stevens | 310/26 |
| 3,175,132 | 3/1965 | Salter | 310/26 |
| 3,194,162 | 7/1965 | Williams | 417/322 |
| 3,349,304 | 10/1967 | Wachter | 310/26 |
| 3,391,680 | 7/1968 | Benson | 417/322 |
| 4,096,735 | 6/1978 | Huntzinger et al. | 310/26 |
| 4,726,741 | 2/1988 | Cusack | 417/322 |

FOREIGN PATENT DOCUMENTS 2822442 12/1979 Fed. Rep. of Germany ..... 417/417

*Primary Examiner*—Donald E. Stout

*Attorney, Agent, or Firm*—David J. Koris

[57] ABSTRACT

A hydraulic pump having a pump cylinder closed at one end with an elongated piston arranged within the cylinder from the other end. The piston is constructed of a magnetostrictive material which increases in length in the presence of a magnetic field of appropriate intensity. It is wound along its length with a coil of wire capable of producing an electromagnetic field. The piston is fastened at the open end of the cylinder to define a cylinder cavity between the cylinder closed end and the piston. A pair of passages, including valves, an intake and an exhaust passage valve communicate with this cavity. The volume of this cavity is reduced when the piston expands under the influence of the magnetic field created by the coil to produce a pressure on any fluid contained within said cavity to force it out the exhaust passage to activate the hydraulic cylinder. In an alternate embodiment the piston is constructed of a magnetostrictive material which decreases in length in the presence of a magnetic field of appropriate intensity. In a further embodiment the cylinder is constructed of a negative magnetostrictive material which contracts or shrinks in length in the presence of a magnetic field. The volume of the cylinder cavity is reduced when the piston expands and the cylinder shrinks under the influence of the magnetic field created by the coil to produce a pressure on any fluid to force it out the exhaust passage.

18 Claims, 2 Drawing Sheets

MAGNETOSTRICTIVE PUMP

This is a continuation-in-part of U.S. copending patent applications Ser. Nos. 759,557, 759,558 and 759,552 claiming a priority date of July 26, 1985, all now abandoned.

CROSS REFERENCES TO RELATED APPLICATIONS

This application is related to the following copending applications of applicant filed at the same time and assigned tot he same assignee:

Magnetostrictive Pump with Hydraulic Pump with Reversible Valves, Ser. No. 905,007, now allowed.

Magnetostrictive Hydraulic Injector, Ser. No. 904,447, now allowed.

Magnetostrictive Hydraulic Pump with Hydraulic Cylinder Ser. No. 918,220, now U.S. Pat. No. 4,726,741.

FIELD OF THE INVENTION

This invention relates to a fluid pump and more particularly to a reciprocating piston pump where in the piston is reciprocated magnetostrictively or alternatively with the aid of a magnetostrictive cylinder.

BACKGROUND OF THE INVENTION

It is known in the present state of the art to provide magnetically actuated pumps wherein an electromagnet is used to reciprocate a piston or flexible diaphragm through suitable linkage to provide the required volumetric displacement. These types of pumps however do not readily adapt themselves to applications where they are required to produce measured amounts of fluid at high pressures.

It is also known that certain metals when placed in a magnetic field react by changing their dimensions. This effect is known as magnetostriction. A more thorough discussion of this phenomenon may be found in the book authored by Richard M. Bozorth entitled "Ferro-Magnetism" and published by the D. Van Nostrand Co. Inc. (September 1968).

SUMMARY OF THE INVENTION

Accordingly, it is an object of the present invention to produce a hydraulic pump capablee of producing a pressure utilizing the magnetostrictive effect.

It is another object of the present invention to produce such a pump which is readily and economically manufactured.

It is a further object of the present invention that the pump output a constant volume displacement for each operation.

It is yet a further object of the present invention to utilize both the positive expansive and negative contractive magnetostrictive qualities in a small device.

These and other objects and features of the present inventions are accomplished in a simple cylindrical pump having a piston of magnetostrictive metal wrapped in an electromagnet and fastened at one end to the cylinder with the other end free within the cylinder to move axially. The cylinder is closed at the end facing the pistons free end to enclose a cylinder cavity. By the provision of an intake and exhaust passage each including a valve arrangement communicating with the cavity, the piston ends reciprocating motion results in a pumping action governed by the strength of the magnetic field created by the coil and the constants of the metal used to make the piston and the cylinder.

BRIEF DESCRIPTION OF THE DRAWING

For a more complete understanding of the invention, reference may be had to the following detailed description of the invention inconjunction with the drawing wherein.

DESCRIPTION OF THE PREFERRED EMBODIMENT

Figure 1:
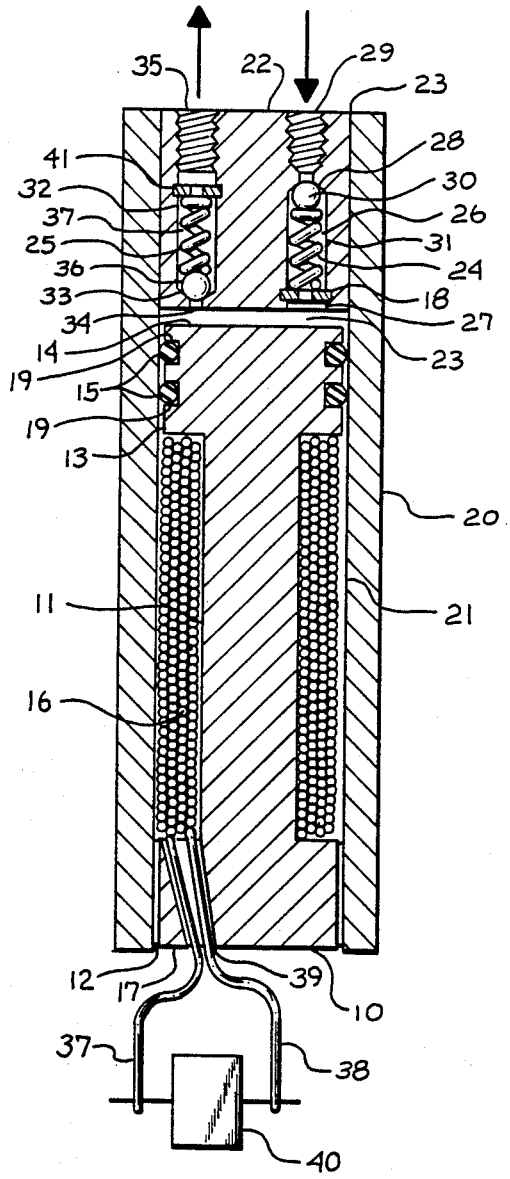
FIG. 1 illustrates in a sectional view the structure of the novel pump and actuator assembly having an electro-magnetic coil wound about the piston.

The novel hydraulic pump of the present invention as shown in FIG. 1 consists of a cylindrical pump housing 20 with a coaxial pump piston 10 within it. The pump cylinder 20 is shown as made of a solid metal but in this preferred embodiment it would be laminated to enhance its performance at higher frequencies of operation. The pump piston should also be laminated or assembled of rods for the same reasons. The piston 10 is fastened at its base end to the cylinders inner surface 21 at interface 12. The piston somewhat resembles a spool in that it is axially recessed 11 along its outer surface to receive a magnetizing coil 16 wound around it as a core. The coil terminals 37 and 38 are taken out via a passage 39 and may be connected to an energizing and control source shown at box 40. The unrecessed ends, of the piston, the base end 17 and the piston face end 13 contain the coil as spool ends. The piston face end 13 as shown has two circumferential grooves 15 dimensioned to receive a pair of piston ring seals 19.

Figure 2:
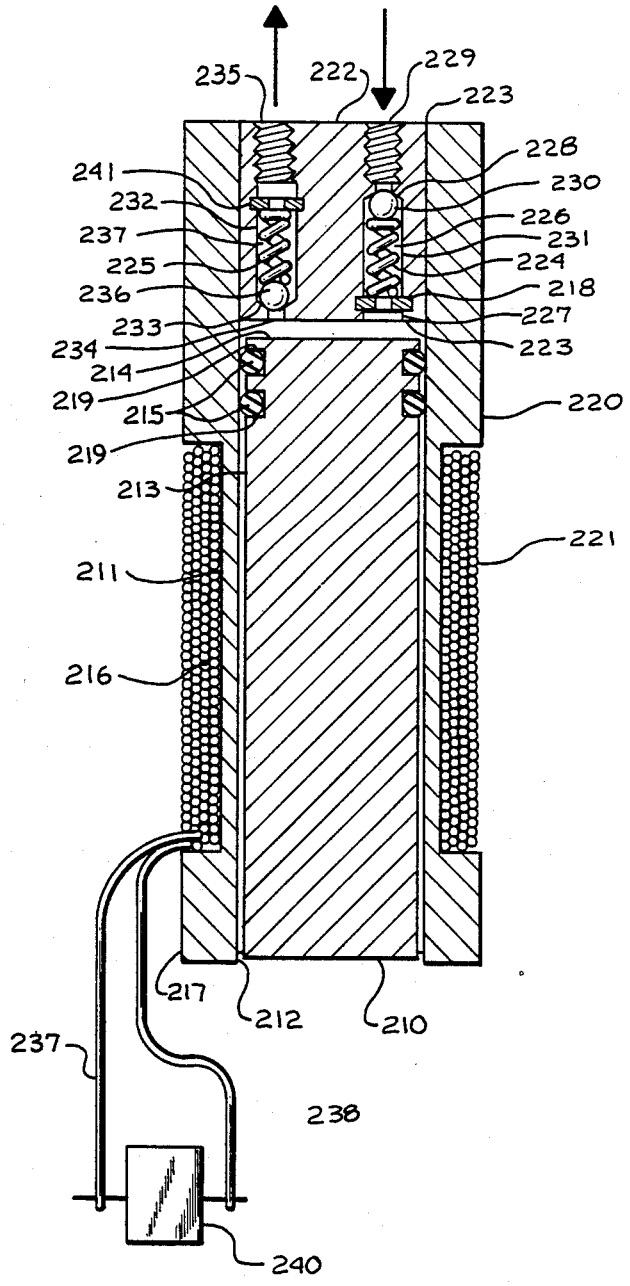
FIG. 2 illustrates in a sectional view the structure of the novel pump and actuator assembly having an electro-magnetic coil wound around the exterior of the pump cylinder.

In an alternate embodiment as shown in FIG. 2 the piston 210 does not have an axial recess for the magnetizing coil. The magnetizing coil 216 is wound around the exterior of the cylindrical shell 220. This arrangement is preferred for applications where it is required that the assembly be free to rotate axially. In such an application the cylindrical shell assembly would be constructed of a non-magnetic material to obviate the possibility of the flux being shunted away from the piston. In other respects the pumps would be similar and corresponding components are labeled with the same numeral prefixed with a 2.

Returning to FIG. 1, the housing 20 of the pump further includes a cylinder head portion 22 suitably fastened to the cylinder's inner surface 21 at the interface 23. Within the cylinder head 22 are included two valves, an intake valve assembly 24 and an exhaust valve assembly 25. The intake valve is located in an enlarged cavity 26 terminated at the cylinder's interior end by a passage 27 and at the exterior end by a valve seat 28 and passage 29 arranged for ready connection to connecting equipment or conduit. The valve itself consists of a ball 30 and a resilient spring assembly 31 urging the ball 30 against the seat 28. The spring is held in place by a retaining member 18. The exhaust or output valve assembly 25 is similarly located in an enlarged cavity 32 within the cylinder head and is terminated at the cylinder end by a valve seat 33 and passage 34 and at the exterior end by a passage 35 also arranged for ready connection to connecting equipment. The exhaust valve assembly consists of a ball 36 and a resiliant spring 37 urging the ball 36 against the valve seat 33. Here also, the spring is retained in its place by a retaining member 41. The valve arrangment as shown is only by way of example for other suitable valve types may be used, such as disc or reed types.

Piston 10 in this example, is constructed of a material that has the property of expanding in the direction of an applied magnetic field. An alloy consisting of 49% Cobalt, 49% Iron and 2% Vanadium more generally known as 2V Permadur is a material that has such a property and provides a displacement of 60 micro inches per inch of length. The magnetic field is supplied by the coil 16, the piston 10 expands lengthwise in the direction of magnetization to displace any fluid contained between the piston face 14 and the cylinder head surface 23' forcing the fluid out through the fluid passage 25 past the check valve 36.

Upon cessation of the current flow through coil 16, the magnetic field within the coil collapses and the piston 10 responds by shrinking back in size to its initial length. This action reduces the pressure within the cylinder, drawing in additional fluid from passage 29 past the check valve assembly 30.

In an alternate embodiment pump piston 10 is constructed of negative magnetostrictive material which has the property of contracting in the direction of an applied magnetic filed. The metal nickel, for example, provides a displacement of 35 micro inches per inch of length with a magnetic field of 250H. The magnetic field is supplied by the coil 16 and an appropriate current source 40. When the current is caused to flow through the coil 16, the piston 10 contracts lengthwise in the direction of magnetization to increase the volume of the chamber between the piston and piston head. The action produces the pressure within the cylinder, drawing in fluid from passage 29 past the check valve assembly 30. Cessation of the current flow causes the magnetic field to collapse causing piston 10 to respond by increasing back in size to its initial length and thereby displacing any fluid contained between the piston face 14 and the cylinder head surface 23 out through the fluid passage 25 past the check valve 36.

In a further embodiment, the cylinder is constructed of a mangetostrictive material of a negativee characteristic such as nickel described above. The particular selection of a magnetostrictive material having expansive qualities for the piston and a material having contracting qualities for the cylinder is only by way of example, since ordinarily, the piston may be constructed of a material having contractive qualities and the cylinder of a material having expansive qualities and still result in a pumping action to have the resultant combined movements. In operation piston 10 expands and the cylinder contracts lengthwise under a magnetic field displacing any fluid contained between piston face 14 and the cylinder head surface 23, forcing fluid out through the fluid passage 25 past the check valve 36. With cessation of the current flow through coil 16, the magnetic field within the coil collapses and the piston 10 responds by shrinking with the cylinder expanding back in size to their initial length. This action results the pressure within the cylinder, drawing in additional fluid from passage 29 past the check valve assembly 30. This cycle of operation can then be repeated any number of times as required to move the desired amount of fluid. This pump readily lends itself to step or digital control, in that a measured amount of fluid is passed for each applied pulse thus, it is readily adaptable as a prime source for incremental tool control.

While but a single embodiment of the present invention has been shown it will be obvious to those skilled in the art that numerous modifications may be made without departing from the spirit of the present invention which should be limited only by the scope of the claims appended hereto.

What is claimed is:

1. A fluid pump assembly comprising:

a cylinder having a first and a second end, an elongate piston of a length shorter than said cylinder and having a first and second end, said piston formed of a positive magneto-strictive material, said first end of said piston secured to said first end of said cylinder.

a cylinder head securd to said cylinder second end and having an inlet and an outlet passage, with valve means located in each said passage, and a means to interruptedly apply a magnetic field to said assembly, said piston operated responsive to said magnetic field to expand and expel any fluid located between said piston and head via said outlet passage and past said valve.

2. A fluid pump assembly as claimed in claim 1 wherein said piston contracts to its original length upon collapse of said magnetic field to draw in any fluid at said inlet passage.

3. A fluid pump assembly is claimed in claim 1 wherein said cylinder is formed of a negative magnetostrictive material.

4. A fluid pump assembly as claimed in claim 3 wherein said cylinder expands to its original length upon collapse of said magnetic field to draw in any fluid at said inlet passage.

5. A fluid pump assembly as claimed in claim 3 wherein said cylinder is operatd to shrink and expel any fluid located between said piston and head via said outlet passage and past said corresponding valve.

6. A fluid pump assembly as claimed in claim 1 wherein said piston includes a circumferentially depressed section between its ends and said means to interruptedly apply a magnetic field comprises a magnetic coil located in said depressed section.

7. A fluid pump assembly as claimed in claim 1 wherein said means to interruptedly apply a magnetic field comprises a magnetic coil wound around the exterior of said cylinder.

8. A fluid pump assembly as claimed in claim 1 wherein said piston is formed of an alloy consisting of 49% Cobalt, 49% Iron and 2% Vanadium.

9. A fluid pump assembly as claimed in claim 1 wherein said cylinder is formed of the metal nickel.

10. A fluid pump assembly comprising:

a cylinder having a first and a second end, an elongate piston of a length shorter than said cylinder and having a first and second end, said piston formed of a negative magnetostrictive material, said first end of said piston secured to said first end of said cylinder, a cylinder head secured to said cylinder second end and having an inlet and an outlet passage with valve means located in each said passage, and a means to interruptedly apply a magnetic field to said assembly, said piston operated responsive to said magnetic field to expand and expel any fluid located between said piston and head via said outlet passage and past said valve.

11. A fluid pump assembly as claimed in claim 10 wherein said cylinder is formed of a positivee magnetostrictive material.

12. A fluid pump assembly as claimed in 11 wherein said cylinder contracts to its original length upon collapse of said magnetic field to draw in any fluid at said inlet passage.

13. A fluid pump assembly as claimed in claim 11 wherein said cylinder is operated to expand and draw fluid between said piston at head via said inlet passage past said corresponding valve.

14. A fluid pump assembly as claimed in claim 10 wherein said piston includes a circumferentially depressed section between its ends and said means to interruptedly apply a magnetic field comprises a magnetic coil located in said depressed section.

15. A fluid pump assembly as claimed in claim 10 wherein said means to interruptedly apply a magnetic field comprises a magnetic coil wound around the exterior of said cylinder.

16. A fluid pump assembly as claimed in claim 10 wherein said piston is formed of an alloy consisting of 49% cobalt, 59% iron, and 2% vanadium.

17. A fluid pump assembly as claimed in claim 10 wherein said cylinder is formed of the metal nickel.

18. A fluid pump assembly as claimed in claim 10 wherein said piston is operated responsive to said magnetic field to contract and draw in any fluid avail- able at its inlet and upon collapse of said field to expand and expel the fluid located between said piston at head via said outlet passage and past said corresponding valve.

* * * * *